US005199874A

United States Patent [19]

Campagnuolo et al.

[11] Patent Number: 5,199,874

[45] Date of Patent: Apr. 6, 1993

[54] APPARATUS AND METHOD FOR INTERFACING INDIRECT-FIRE DEVICES WITH MILES

[75] Inventors: Carl J. Campagnuolo, Potomac; Jerome D. Gerber, Beltsville, both of Md.; Wesley K. Clark, Fort Irwin, Calif.

[73] Assignee: The United States of America as represented by the Secretary of the Army, Washington, D.C.

[21] Appl. No.: 691,603

[22] Filed: Apr. 18, 1991

[51] Int. Cl.[5] ..... F41A 33/00

[52] U.S. Cl. ..... 434/11; 434/16

[58] Field of Search ..... 434/11, 16, 4, 10; 102/211; 340/435, 903, 943

[56] References Cited

U.S. PATENT DOCUMENTS

| | | | |
|---|---|---|---|
| 2,536,327 | 1/1946 | Tolson | 102/211 |
| 4,409,899 | 10/1983 | Owen et al. | 102/211 |
| 4,624,641 | 11/1986 | Gallagher | 434/21 |
| 4,654,008 | 3/1987 | Elmore | 434/16 |
| 4,682,953 | 7/1987 | Doerfel et al. | 434/16 |
| 4,744,761 | 5/1988 | Doerfel et al. | 434/16 |
| 4,823,401 | 4/1989 | Gammarino et al. | 455/606 |
| 5,074,793 | 12/1991 | Hambric et al. | 434/11 |

*Primary Examiner*—Richard J. Apley
*Assistant Examiner*—John P. Leubecker
*Attorney, Agent, or Firm*—Saul Elbaum; Guy M. Miller; Jason M. Shapiro

[57] ABSTRACT

An acoustic receiver for interfacing indirect-fire weapons with the Multiple Integrated Laser Engagement System ("MILES") responds to the presence of a device when the device generates a predetermined acoustic signal upon simulated explosion. The simulator then momentarily disconnects the MILES power supply from the rest of the MILES circuit. This action causes the MILES to generate an audible alarm indicating a hit by the explosive device.

8 Claims, 4 Drawing Sheets

APPARATUS AND METHOD FOR INTERFACING INDIRECT-FIRE DEVICES WITH MILES

RIGHTS OF THE GOVERNMENT

The invention described herein may be manufactured, used and licensed by or for the United States Government for Governmental purposes without payment to us of any royalty thereon.

BACKGROUND OF THE INVENTION

1. Field of the Invention

The present invention relates generally to Multiple Integrated Laser Engagement System ("MILES") type training devices and more particularly to an explosive device simulator system for the miles which responds to devices that generate acoustic signals upon simulated explosion.

2. Description of the Prior Art

The Multiple Integrated Laser Engagement System ("MILES") has revolutionized the way in which armies train for combat. MILES has been fielded with armies of many nations around the world and has become the international standard against which all other Tactical Engagement Simulation ("TES") systems are measured. For the U.S. Army and Marine Corps, MILES is the keystone for their opposing force, free-lay TES Program. It is highly valued in its ability to accurately assess battle outcomes and to teach soldiers the skills required to survive in combat and destroy the enemy.

With MILES, commanders at all levels can conduct opposing force free-play tactical engagement simulation training exercises which duplicate the lethality and stress of actual combat.

The MILES system uses laser bullets to simulate the lethality and realism of the modern tactical battlefield. Eye-safe Gallium Arsenide (GaAs) laser transmitters, capable of shooting pulses of coded infrared energy, simulate the effects of live ammunition. The transmitters are easily attached to and removed from all hand-carried and vehicle mounted direct fire weapons. Detectors located on opposing force troops and vehicles receive the coded laser pulses. MILES decoders then determine whether the target was hit by a weapon which could cause damage (hierarchy of weapons effects) and whether the laser bullet was accurate enough to cause a casualty. The target vehicles or troops are made instantly aware of the accuracy of the shot by means of audio alarms and visual displays, which can indicate either a hit or a near miss.

The coded infrared energy is received by silicon detectors located on the target. In the case of ground troops, the detectors are installed on webbing material which resembles the standard-issue load-carrying lift harness. Additional detectors are attached to a web band which fits on standard-issue helmets. For vehicles, the detectors are mounted on belts which easily attach to the front, rear, and sides. The detectors provide 360 degree coverage in azimuth and sufficient elevation coverage to receive the infrared energy during an air attack. The arriving pulses are sensed by detectors, amplified, and then compared to a threshold level. If the pulses exceed the threshold, a single bit is registered in the detection logic. Once a proper arrangement of bits exists, corresponding to a valid code for a particular weapon, the decoder decides whether the code is a near miss or a hit. If a hit is registered, a hierarchy decision is then made to determine if this type of weapon can indeed cause a kill against this particular target and, if so, what the probability of the kill might be.

While great success has been enjoyed with weapons that can be aimed there has been no convenient or economic way for the military to train with grenades that interact with the MILES system. This is because a grenade rotates during its ballistic flight path and would require several laser emitters so that at least one would be pointed at a target. However, even a large number of emitters would not assure a hit. Due to these difficulties, no grenade exists that interacts with the present MILES system. Consequently, there is a great need to find a way in which grenades and other ballistic or variable-directional flight path type weapons can be used in training exercises with MILES.

SUMMARY OF THE INVENTION

Accordingly, it is an object of the present invention to provide a MILES simulator system that interacts with variable-directional weapons such as grenades.

It is another object of the present invention to provide a variable-directional weapon simulator system that interacts with MILES without having to radically change the MILES.

It is still another object of the invention to provide a variable-directional weapon simulator system that interacts with MILES in an economical and efficient way.

The present invention achieves these objectives by using a predetermined acoustic signal to simulate an explosion in combination with receiver circuitry sensitive to the acoustic signal and operatively connected to the existing MILES power supply. A special feature, commonly referred to as the tampering circuit, presently incorporated in the MILES provides for an audible alarm to be activated upon removal and reinsertion of the MILES power source. This feature prevents someone from cheating by deactivating his MILES receiver during simulated combat. When the power source (typically a battery) is reinstalled an audible alarm is sounded. Consequently, by momentarily removing the MILES power source from the circuit for a brief instant and then reconnecting it back into the circuit the present invention is able to indicate a kill on MILES. This operation is performed when receiver circuitry detects a predetermined acoustic signal of sufficient amplitude and duration or can even be a coded acoustic signal. An acoustic signal overcomes the disadvantage of highly directional laser pulses because of its substantially omnidirectional propagation characteristics.

Consequently, a grenade, or other variable-directional explosive type device, that incorporates a sonic device or buzzer will be able to interact with the MILES that have been fitted with the present invention. The use of a pull pin and switch arrangement provides soldiers with a realistic grenade for use in training operations. An optional "safety" lever pivotally attached to the grenade can be used to hold the switch open and provide realistic operation. A grenade that generates an audible signal is described in a copending application, Ser. No. 07/608,923, entitled "TRAINING GRENADE" and is assigned to same assignee, the U.S. Government, as in this case.

The acoustic signal generated by the grenade is detected by receiver circuitry located and operatively connected to the power supply source for the MILES. The operational sequence of the simulator system is as follows. When a grenade is activated there is approximately a three second delay before a flash bulb fires. A flash may be used to provide a visual means for indicating that an explosion has occurred but, it is not essential. A delay is also advantageous so that the thrower does not activate his own receiver circuitry. After the flash fires a buzzer sounds for approximately three seconds. Obviously, other time periods may be selected. A means for detecting the acoustic signal, for example a microphone, is located on each target which has been fitted with a MILES. Targets can be vehicles, soldiers, buildings, etc. The microphone that detects the sound generated by the grenade is connected to receiver and identification circuitry. The output of the receiver is used as a trigger signal to momentarily remove the MILES power source from the rest of the MILES circuit. This results in the MILES audible alarm being activated.

The present invention is not limited to using a grenade. Various training devices, particularly ones that have variable-directional flight paths, can be designed to generate a predetermined audible signal simulative of an explosion. However, the present disclosure will primarily be directed towards the use of an audible grenade and its interaction with the simulator receiver circuitry.

BRIEF DESCRIPTION OF THE DRAWINGS

The foregoing and other objects, aspects, uses and advantages of the present invention will be more fully appreciated as the same becomes better understood when considered in connection with the following detailed description of the present invention and in conjunction with the accompanying drawings, in which.

DESCRIPTION OF THE PREFERRED EMBODIMENTS

Figure 1:
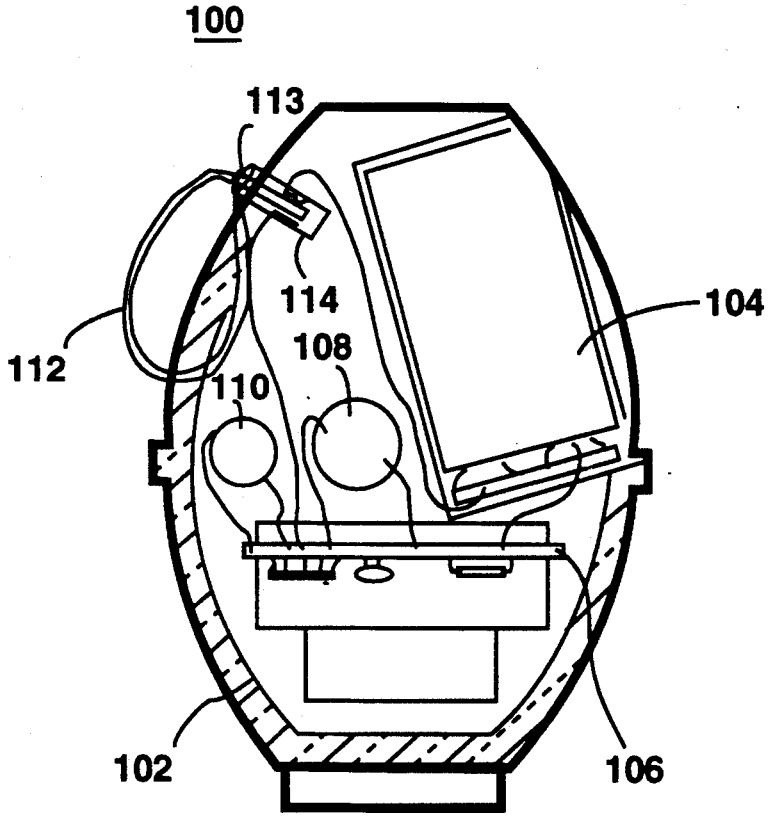
FIG. 1 shows a cross sectional view of a training grenade that can be used to generate an acoustic signal according to an aspect of the invention.

Referring now to the drawings, like reference numerals represent identical or corresponding parts throughout the several views. Before a description is given on the receiver circuitry a description of an audible grenade of the type that can be used in the present invention will be described.

A cross sectional view of a grenade 100, having a barrel shape as used in many fragmentation grenades, is shown in FIG. 1. The housing 102 may be made from a transparent or translucent, synthetic, flexible or shock resistant material. The grenade 100 contains a power supply or standard 9 volt battery 104 to power an electronic circuit mounted on circuit board 106 which fires a light emitting device 108 which then triggers a buzzer 110. Obviously, the grenade 100 need not be transparent nor translucent if a flash bulb is not used. If a flash bulb is used it illuminates the translucent housing 102 of the grenade 100. The light emitting device 108 could be, for example, a common type camera flash bulb such as a Sylvania Blue Dot, a light emitting diode, or a xenon flash beacon. Removing the pull ring 112 and safety pin 113 causes a phone type switch 114 to close, thereby providing power to the circuit.

Figure 2:
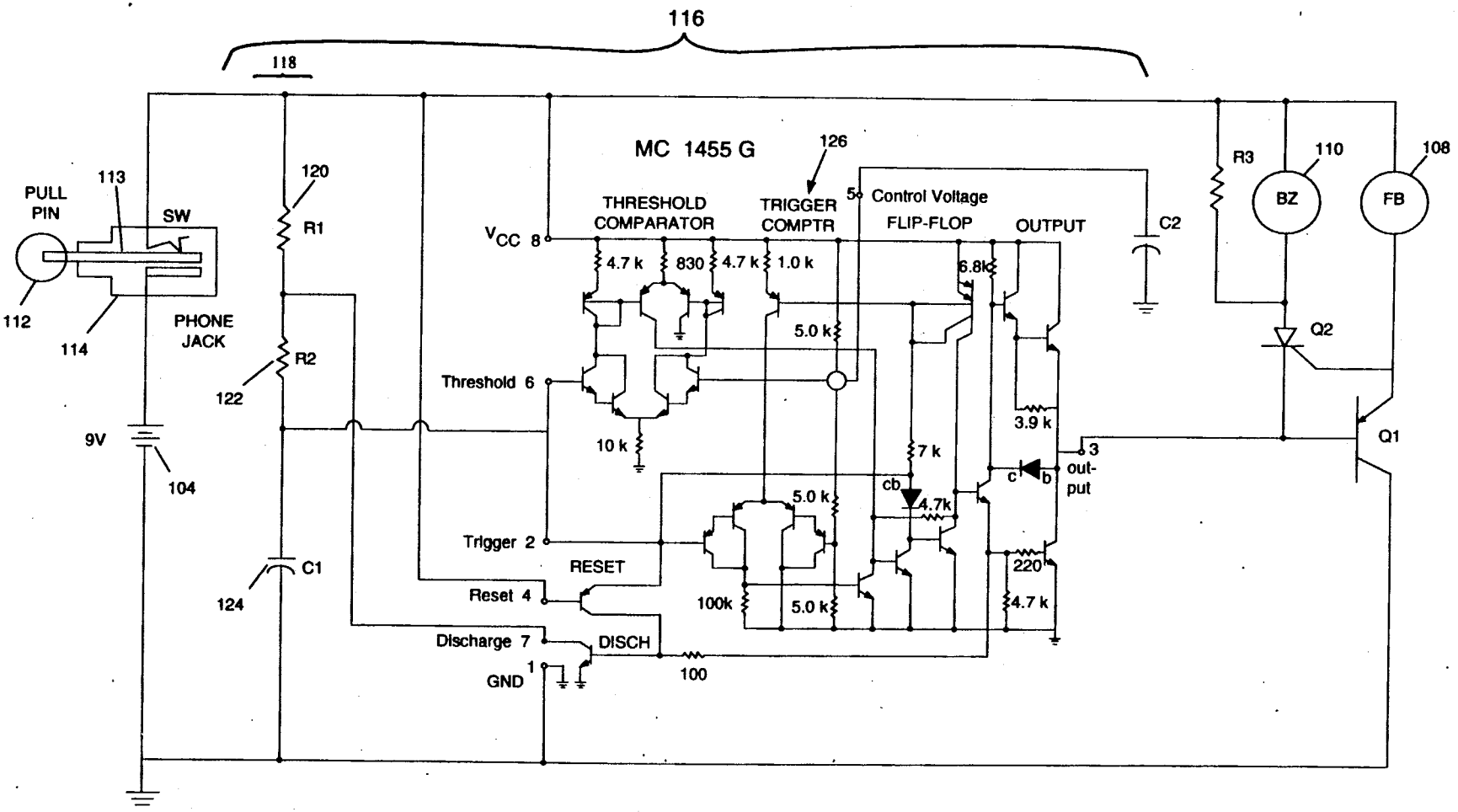
FIG. 2 shows an electrical schematic diagram of a training grenade as depicted in FIG. 1.

The electronic circuit mounted on circuit board 106 is shown in schematic form in FIG. 2 and comprises a phone type switch 114, a flash bulb 108, a buzzer 110, and activation means 116. The activation means 116 comprises battery 104, a timing means 118 which may comprise a resistor 120 (R1), resistor 122 (R2) and capacitor 124 (C1) network, and a Motorola MC1455 monolithic timing circuit 126. Upon removal of the safety pin 113, by pulling on a safety pin pull ring 112, the switch 114, in series combination with battery 104, closes. The removal of the safety pin 113 starts the charging of timing means 118 within the activation means 116. After approximately a three second delay the flash bulb 108 is fired. This causes the buzzer 110 to sound for approximately three seconds thereby simulating the spread of fragments.

Figure 3:
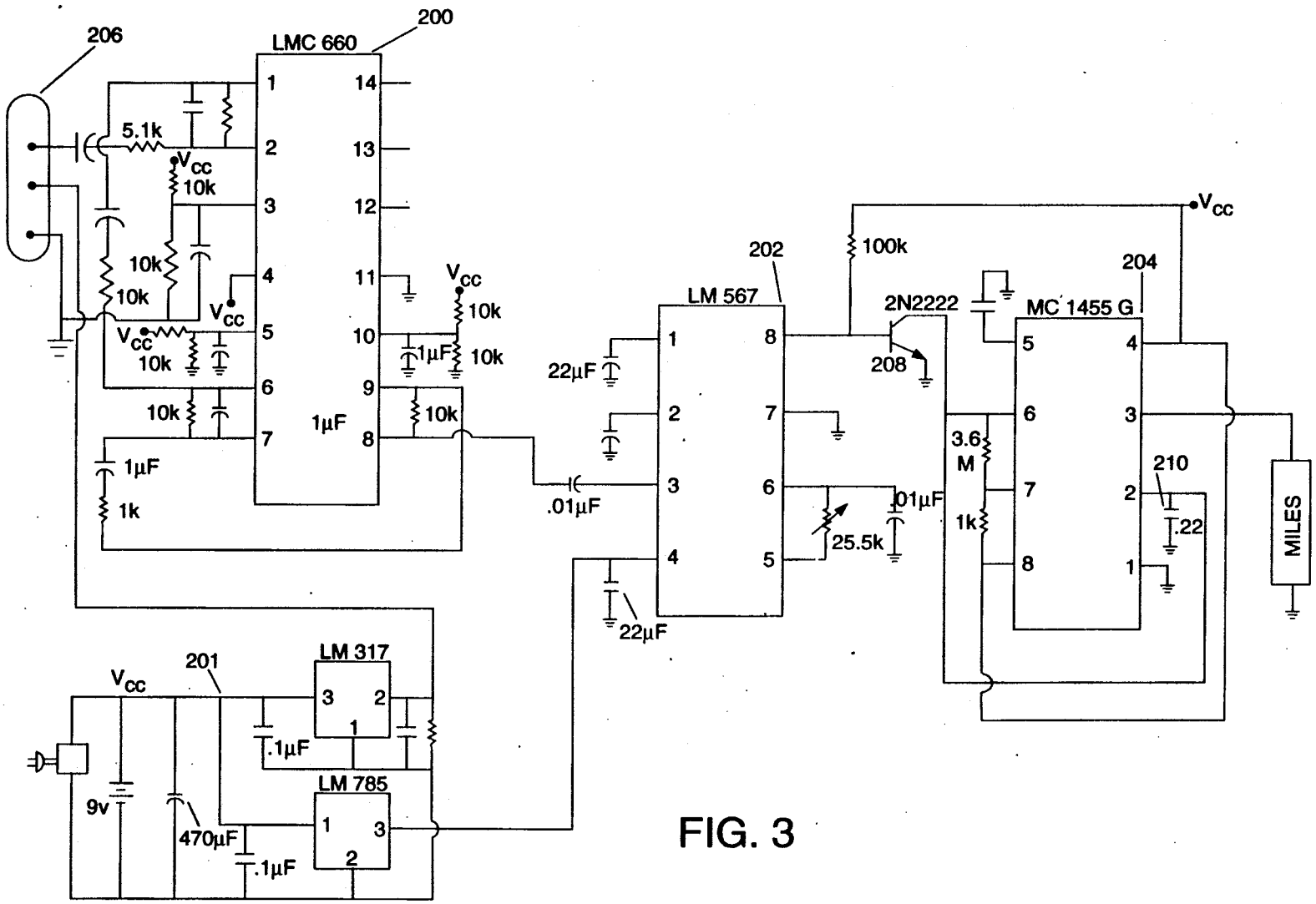
FIG. 3 shows an electrical schematic diagram of a basic embodiment of the receiver circuitry according to an aspect of the invention.

FIG. 3 shows a schematic of the receiver or MILES interface circuitry which comprises a quad operational amplifier (LMC 660) 200, a phase lock loop (LM 567) 202, a timer circuit (MC 1455G) 204, a microphone 206 and various discrete components. A rechargeable power section 201 provides voltage to the applicable circuitry. All of the functions performed by the receiver circuitry are accomplished using conventional, off the shelf, components with values shown as merely exemplary of an operational device.

When an acoustic signal is received from an acoustic training device, such as the grenade previously described, the signal is detected by the microphone 206. A conventional hearing aid may be used as the microphone 206. The output of the microphone 206 is fed to the quad amplifier 200. The quad amplifier 200 is configured as two cascaded bandpass filters followed by an active high pass filter. The filters are frequency adjusted to center around the emitting frequency of the acoustic training device and to amplify the microphone output. The output (pin 8) of the quad amplifier 200 is fed to the input (pin 3) of phase lock loop 202. The phase lock loop 202 is configured as a narrow band tone detector. The output (pin 8) of the phase lock loop 202 goes low when a signal of the proper frequency is presented to the input (pin 3) of the phase lock loop 202. The output (pin 8) of the phase lock loop going low causes the base on transistor 208 to go low which allows capacitor 210 to charge. If the output (pin 8) of the phase lock loop 202 stays low long enough for capacitor 210 to charge beyond a set threshold, power supplied (by pin 3) to the MILES through timer 204 is removed. The MILES is thus supplied power through the output of timer 204 in place of the normal battery in the MILES. Power remains removed from the MILES until the acoustic signal is no longer received from the acoustic training device. When the acoustic signal is no longer being received power is restored to the MILES and the tampering circuit activates an internal audible alarm indicating a "hit" has taken place. Recall that the audible alarm is activated if the power to the MILES is momentarily removed and then reconnected.

Figure 4:
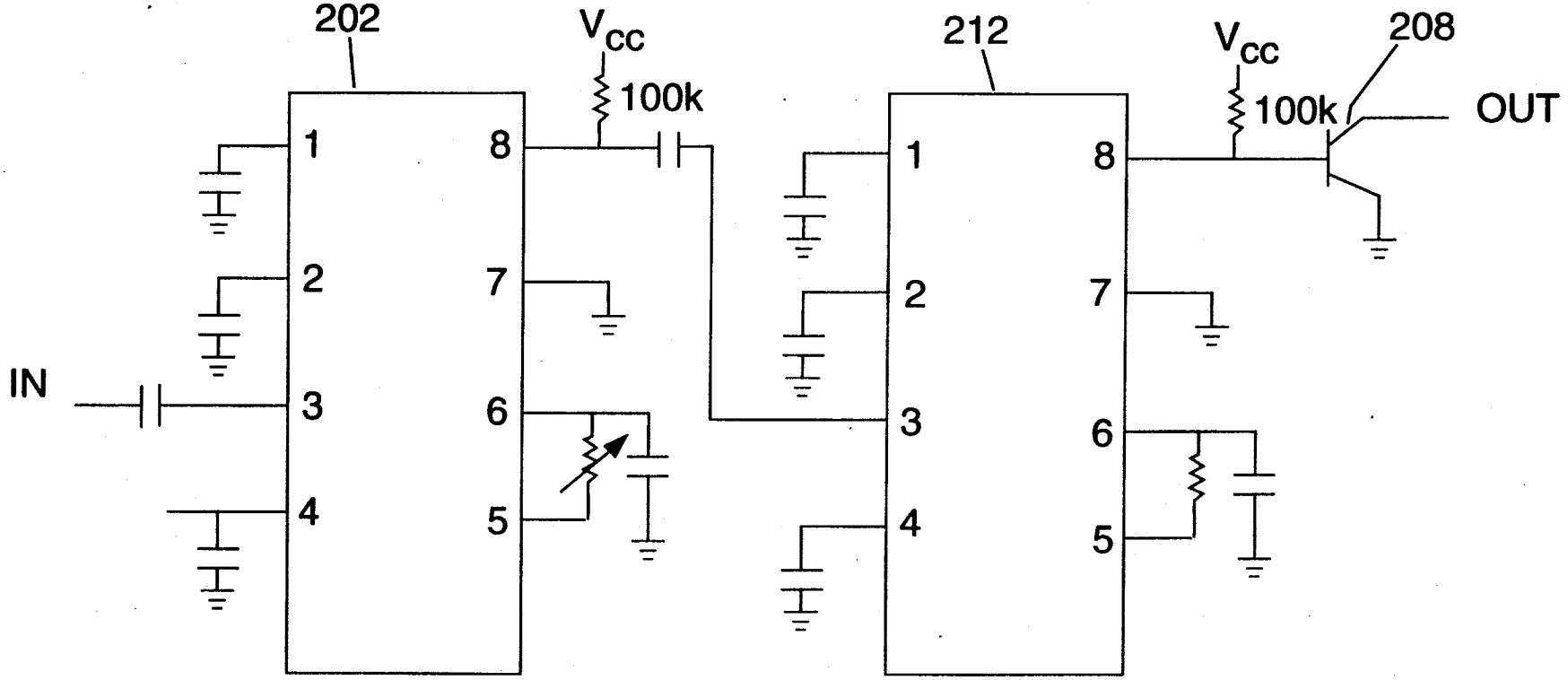
FIG. 4 shows a partial electrical schematic diagram of decoding circuitry as added to the circuitry as shown in FIG. 3.

Another embodiment of the present invention is shown in FIG. 4 and includes an additional phase lock loop 212. An additional phase lock loop provides for receiving coded pulse modulated signals transmitted from the acoustic training device. Only that portion of the circuit centered around the additional circuitry is shown. The remaining portion is identical as provided in FIG. 3.

The circuity preceeding the input (pin 3) of phase lock loop 202 remains the same as shown in FIG. 3. The input signal comes from the quad amplifier 200. The output (pin 8) of phase lock loop 202 goes high and low at the pulse modulation rate of the acoustic training device. A second phase lock loop 212 is inserted between phase lock loop 202 and transistor 208 and acts as a tone decoder that only locks on to a signal at the modulation frequency. The output (pin 8) of phase lock loop 212 goes low when an acoustic signal of the right frequency and modulation rate is received. The remaining portion of the circuit is identical and operates as that shown in FIG. 3.

Obviously, numerous modifications and variations of the present invention are possible in light of the above teachings. It is therefore to be understood that within the scope of the appended claims, the invention may be practiced otherwise than as specifically described herein.

What is claimed is:

1. An acoustic receiver for use with a MILES-type tactical engagement simulation system supplied with a tampering circuit, said acoustic receiver comprising:

means for detecting an acoustic signal, means responsive to said detecting means for identifying the presence of a device when the device generates a predetermined acoustic signal, and means responsive to said identifying means for momentarily removing a power supply source from a MILES-type system, wherein said means for momentarily removing comprises means for activating a tampering circuit upon identification of the predetermined acoustic signal.

2. The acoustic receiver of claim 1 wherein said identifying means comprises, means for filtering the predetermined acoustic signal, means for amplifying the predetermined acoustic signal after the predetermined acoustic signals has been filtered, and a phase lock loop tuned to lock onto the predetermined acoustic signal.

3. The acoustic receiver of claim 1 or 2 wherein said means for momentarily removing a power supply source from a MILES-type system comprises an electronic switch connected in series between the MILES-type system and a power supply source.

4. An acoustic receiver for use with a MILES-type tactical engagement simulation system supplied with a tampering circuit, said acoustic receiver comprising:

means for detecting an acoustic signal;

means responsive to said detecting means for identifying the presence of a device when the device generates a predetermined acoustic signal, said identifying means comprising means for filtering the predetermined acoustic signal, means for amplifying the predetermined acoustic signal after the predetermined acoustic signal has been filtered, and a phase lock loop tuned to lock onto the predetermined acoustic signal; and means responsive to said identifying means for momentarily removing a power supply source from a MILES-type system, wherein said means for momentarily removing comprises means for activating a tampering circuit upon identification of the predetermined acoustic signal, and an electronic timer responsive to said phase lock loop.

5. A method for interfacing indirect-fire training devices with a MILES-type tactical engagement system supplied with a tampering circuit, said method comprising the steps of:

(a) activating an indirect-fire training device, said activation causing an omnidirectional signal of a particular frequency and duration to be generated by said device;

(b) detecting said omnidirectional signal;

(c) determining whether the signal detected is of the particular frequency and duration associated with an indirect-fire training device;

(d) interrupting the supply of power to the MILES in the event that an indirect-fire training device has been detected;

(e) re-establishing the supply of power to the MILES; whereby the tampering circuit of the MILES will cause an audible alarm to sound, said alarm indicating that an object has been killed.

6. A method for interfacing indirect-fire training devices with a MILES-type tactical engagement system supplied with a tampering circuit, said method comprising the steps of:

(a) activating an indirect-fire training device, said activation causing an omnidirectional signal of a particular frequency and duration to be generated by said device;

(b) detecting said omnidirectional signal;

(c) filtering said omnidirectional signal about said particular frequency;

(f) amplifying said filtered signal;

(g) passing said amplified signal through a phase lock loop, whereby a signal of said particular frequency will cause the output of said phase lock loop to charge a capacitor;

(d) interrupting the supply of power to the MILES in the event said capacitor is charged beyond a predetermined threshold related to the duration of said omnidirectional signal;

(e) re-establishing the supply of power to the MILES when the signal is no longer detected;

whereby the tampering circuit of the MILES will cause an audible alarm to sound, said alarm indicating that an object has been killed.

7. In a MILES-type tactical engagement system receiving unit for use with an audible signaling device, said unit comprising a power supply, optical detectors, decoding circuitry, and means to indicate a kill when said power supply is removed and subsequently reinserted, the improvement comprising:

means to detect an audible signal;

means responsive to said detection means for identifying the presence of a device when the device generates an audible signal of a particular frequency and duration; and means responsive to said identifying means for momentarily interrupting the supply of power to the receiving unit;

whereby a kill will be indicated in response to said audible signal without complicated interfacing circuitry.

8. A tactical engagement training system for simulating the effects of both line-of-sight and omnidirectional weaponry in war games, said system comprising:

a MILES-type tactical engagement system for transmitting and receiving optical signals, decoding said signals, and indicating a kill when an appropriate signal is received, said MILES-type system comprising means to transmit an optical signal, means independent of said transmitting means for receiving optical signals, means for decoding optical signals which are received, means to prevent tampering with said receiving means, and means to indicate a kill when an appropriate signal is detected or said receiving means is tampered with, said receiving means being supplied with a power supply, the presence of which is monitored by said means to prevent tampering;

an acoustic training device for simulating the effects of a weapon posing an omnidirectional threat in a tactical engagement simulation system, said device comprising a housing which resembles in size and shape the weapon to be simulated; a power supply disposed within said housing; means to generate an audible signal of a particular frequency and duration, activate said means for generating an audible signal;

an acoustic receiver comprising means to detect an audible signal; means responsive to said detection means for identifying the presence of an acoustic training device when the device generates an audible signal of a particular frequency and duration; and means responsive to said identifying means for momentarily interrupting the supply of power to the optical receiving unit and decoder thereby activating said tampering means;

whereby a kill can be indicated either in response to an optical signal through the MILES-type system decoding circuitry, or in response to a particular audible signal through the use of the tampering feature.

* * * * *